US007290603B2

(12) United States Patent
Hiorth et al.

(10) Patent No.: US 7,290,603 B2
(45) Date of Patent: Nov. 6, 2007

(54) DOWNHOLE PLUG

(75) Inventors: Espen Hiorth, Trondheim (NO); Asbjörn Nervik, Saupstad (NO)

(73) Assignee: Bronnteknologiutvikling AS, Trondheim (NO)

( * ) Notice: Subject to any disclaimer, the term of this patent is extended or adjusted under 35 U.S.C. 154(b) by 193 days.

(21) Appl. No.: 10/973,005

(22) Filed: Oct. 25, 2004

(65) Prior Publication Data

US 2006/0005963 A1 Jan. 12, 2006

(30) Foreign Application Priority Data

Jul. 9, 2004 (NO) ..... 20042939

(51) Int. Cl.
*E21B 23/00* (2006.01)

(52) U.S. Cl. ..... 166/136; 166/196; 166/135; 166/192; 166/118; 166/141

(58) Field of Classification Search ..... 166/196, 166/135, 192, 118, 136, 141
See application file for complete search history.

(56) References Cited

U.S. PATENT DOCUMENTS 5,010,958 A * 4/1991 Meek et al. ..... 166/382
6,695,051 B2 * 2/2004 Smith et al. ..... 166/134
2004/0003928 A1 * 1/2004 Frazier ..... 166/387

* cited by examiner

*Primary Examiner*—David Bagnell
*Assistant Examiner*—Brad Harcourt
(74) *Attorney, Agent, or Firm*—Alix, Yale & Ristas, LLP

(57) ABSTRACT

Downhole plug, especially designed for closing an annular conduit in an oil or gas well, under high pressure and temperature. It has two radially expandable ring elements 13, 15, which are arranged on a carrying cylindrical element 32, between two mutually axially movable pressure elements 12, 14, having an expansion sleeve in between. The ring elements can, by insertion of the downhole plug in a well, be expanded from an inner position, seen radially, to a sealing position against the wall of the well. The radially expandable ring elements 13, 15, comprises a closed series of circumferentially overlapping seal elements 13A, 15 A. By the expanding movement they are mutually moved in the circumferential direction, thereby maintaining a seal against each other. They form an outer sealing surface 38, which can provide a seal against a cylindrical pipe wall, and they have an inwards facing sealing surface 47.

17 Claims, 3 Drawing Sheets

11
32
35
42
48
30
22
27
24
38
28
29
31
33
34
47
15A
13A
21
26
25
23
13
20
16
17
15
22
14
18
12
19

DOWNHOLE PLUG

BACKGROUND OF THE INVENTION

The present invention relates to a downhole plug, especially for use in oil and gas wells, which contain high pressure and temperature.

For the sealing of oil and gas wells which are to be either temporarily or permanently shut off, generally, a downhole plug is used which seals the well by means of expanding gaskets. In wells under high pressure (e.g. higher than say 5000 psi), combined with high temperature (e.g. higher than 150° C.), gaskets containing elements of rubber or some other elastomer will have a limited operating life. Thus, downhole plugs having metal gaskets which can stand exposure to substantially higher pressures and temperatures than pure elastomer gaskets have been proposed.

EP patent specification 1277915 (Shell Int. Research, 2003) discloses the making of downhole plugs where the gasket element comprises a series of metal sleeves, positioned after each other along a core, and having an edge overlap. To seal, the metal sleeves are pressed together in such a way that they are forced to slide upon each other, forming a thicker stack. This design, however, is structurally weak when removing the downhole plug after use.

WO03058026 (Flaaten et. al., 2003) discloses a downhole plug, having a sealing sleeve with a meander-shaped ring element, which is in a cylindrical plane, and which expands radially, by axial compression against the tops of the meander-shape. In this way, sealing is achieved along the support surface of the element against the wall of the well. A substantial disadvantage with this sealing sleeve is that it does not contract when the axial pressure effect is removed. This proposal is thus not very suitable for downhole plugs, intended to temporarily seal wells, and to be removed after use.

SUMMARY OF THE INVENTION

The main object of the invention is to provide a downhole plug to withstand high pressure and temperature (HPHT-plug), which provides both an effective seal during the active HPHT-conditions, and which can be removed from the well after use. High reliability and wear resistance are also desired with such dowhole plugs. Furthermore, economics, both for its manufacture, and during operation, will be a factor for such equipment.

By use of the inventive downhole plug, it is possible to provide a secure seal during the most extreme conditions of utilization, regarding pressure and temperature. Furthermore, the new downhole plug can be removed from the well without failure, due to the design of the seal elements ("dogs") and their fastening.

BRIEF DESCRIPTIONS OF THE DRAWINGS

Further details and advantages of the invention will be described in the following example, with reference to the drawings, wherein.

Figure 1:
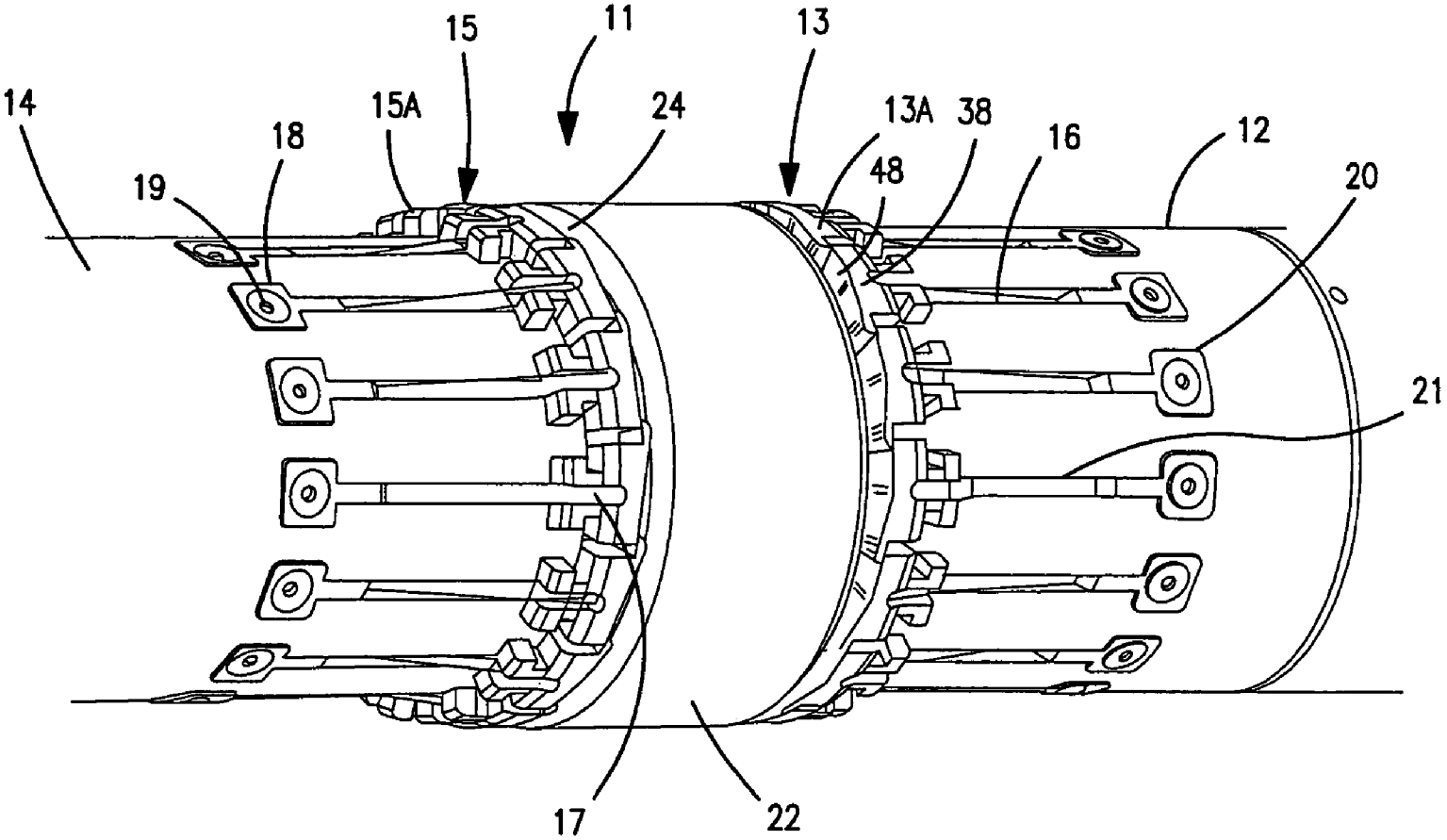
FIG. 1 is a perspective view of the sealing part of a downhole plug according to the invention, before insertion downhole.
Figures 2A, 2B, 3A, 3B:
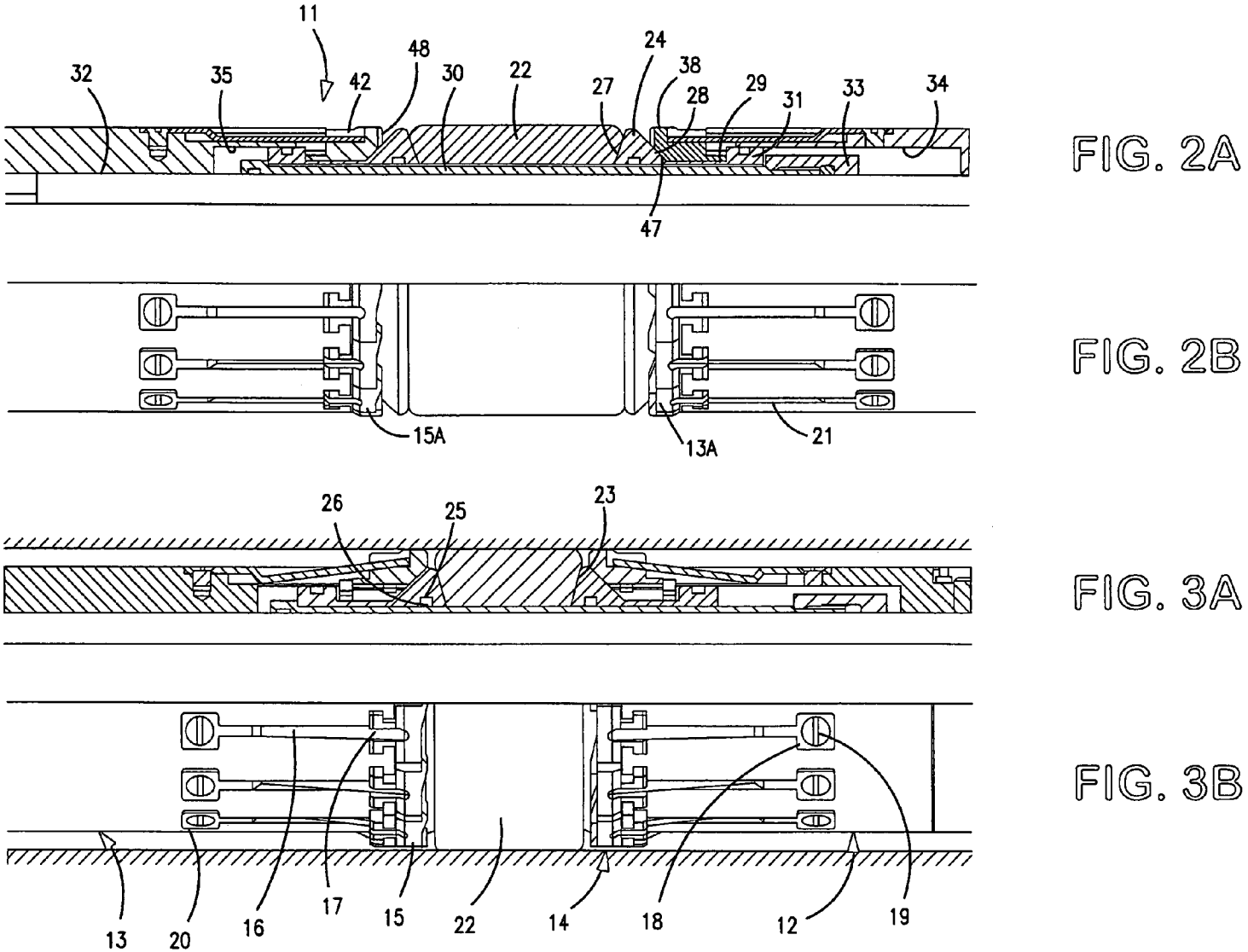
FIGS. 2A and 2B are sectional and exploded view from the side of the sealing part of FIG. 1, in which the gasket element is not-expanded, and without pressure.
Figure 4:
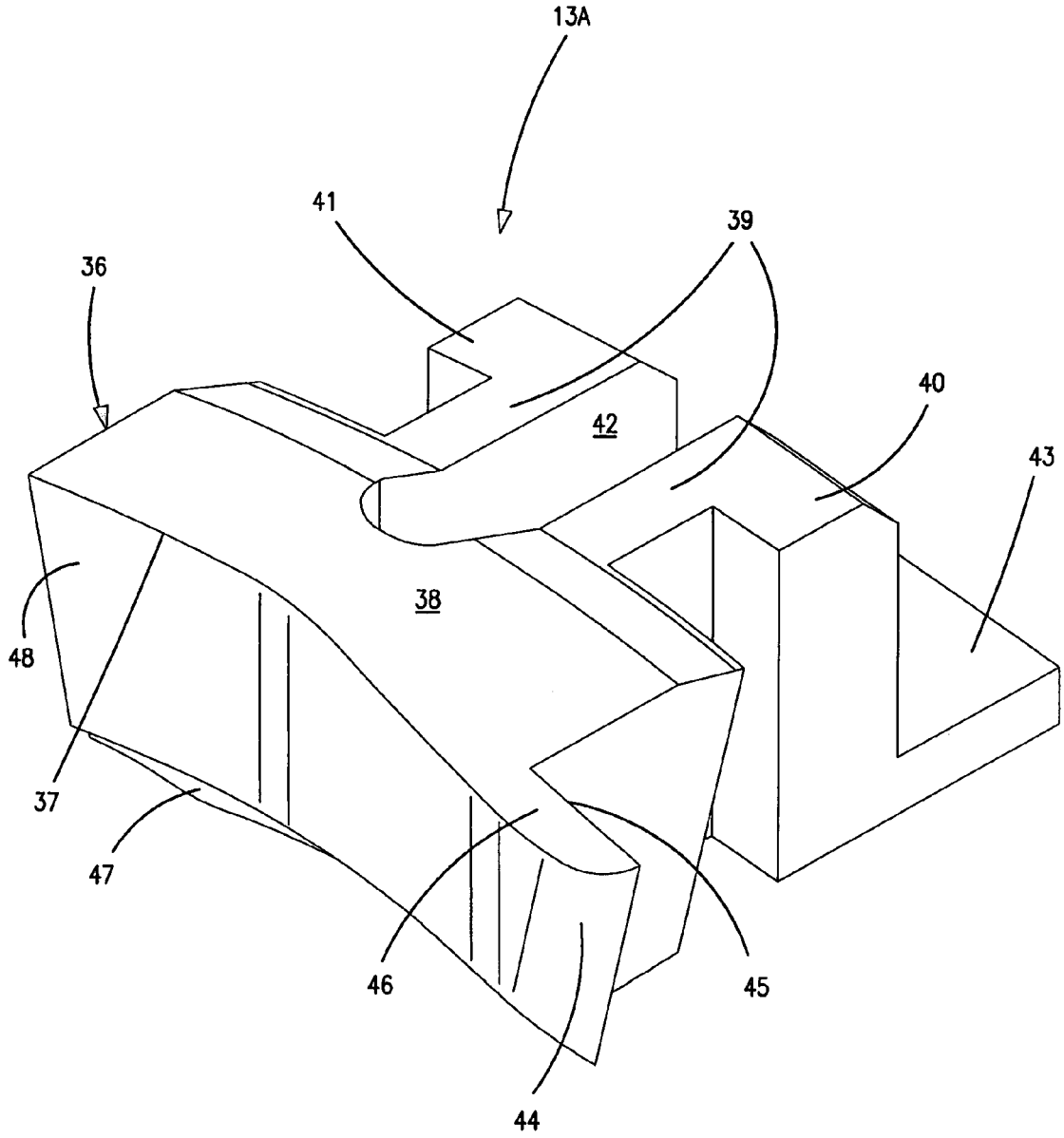

FIGS. 3A and 3B correspond respectively to FIGS. 2A and 2B but in the activated downhole condition, with a pressure affected gasket element; and FIG. 4 is a perspective view of a seal element for use with the downhole plug of FIGS. 1-3.

DESCRIPTION OF THE PREFERRED EMBODIMENT

The downhole plug 11 in FIG. 1 is shown in a horizontal position, however, it will, in practice, be used in wells that are vertical, and wells that are at different angles relative to this direction. For the different elements the terms "upper" and "lower" are used, related to its normal orientation. The downhole plug has an upper annular casing 12, on the right side of the drawing, which accommodates an upper annular series 13 of seal elements 13A and a lower annular casing 14 for a corresponding annular series 15 of lower seal elements 15A.

Each annular series 13, 15 of seal elements 13A, 15A, contains, in the example, fourteen seal elements, but this number may vary, depending on the diameter of the downhole plug and the design of the seal elements 13A, 15A.

A leaf shaped compression spring 16 biases each of the seal elements 13A, 15A. The compression spring 16, is, at one end, fixed to the adjacent casing 12 or 14. At the seal elements 13A, 15A, the compression spring 16 has a tongue-shaped end 17, which engages in a recess 42 (FIG. 4) in the seal element 13A, 15A. At the outer end, the compression spring 16 has an end expansion or a mounting plate 18, which has an opening for a fixing screw 19, which enters the casing 12, or 14. In the casing 12, 14, there is a recess 20, which accommodates the mounting plate 18. The main part of the compression spring 16 is positioned in a longitudinal groove 21 in the casing 12 and 14 respectively. Details of the seal elements 13A, 15A, are shown in FIG. 4 and described below.

Between the two annular series 13, 15 of seal elements 13A, 15A, there is arranged an expansion sleeve 22 of rubber, or another type of elastic material. The expansion sleeve 22 is of a cylindrical shape, and has ends 23, which have a conical undercut. The resulting overhang at each end, provides support against an abutting pressure ring 24 (FIGS. 2 and 3).

In FIG. 2, the downhole plug 11 is shown in a pressure released state, for insertion and pulling, corresponding to the state in FIG. 1. In FIG. 3, it is shown in an expanded sealing state, as it will function in a downhole well.

The pressure rings 24 have a base part, with substanbtially conically converging outer surfaces that lead to a rounded top, and an inner circumferential groove 25, which contains a seal ring 26 (FIGS. 2 and 3). One outer surface of the conical pressure ring 24 has a steep bevelled edge 27 adjacent the expansion sleeve 22, and an edge 28 adjacent the seal elements 13A, 15 A, of a less steep bevel. The pressure rings 24 are integrated with a sleeve 29, which is slidable with support along a sleeve-shaped pull down mandrel 30, and with an outside ring 31 at the end.

The pull down mandrel 30 is fixed on a sleeve-shaped, central mandrel 32, by means of a clamp nut 33, screwed on the outer end of the pull down mandrel 30. The clamp nut 33 and the ring 31 at the end of the sleeve 29, may be axially displaced within an annular recess 34 in the end of the upper casing 12. There is a corresponding recess 35 in the lower casing 14. The rings 31 have grooves for shear pins, to enable the setting of the plug in well conditions with cross flow by setting the slips prior to the seal element. They may have a ring gasket in an outside groove.

FIG. 4 shows a seal element or a "dog" 13A, 15A. The seal element has a head 36 with a curved main part 37, which forms an arcuate outer sealing surface 38, which can provide a support against the wall of the conduit defining the well. The head 36 is symmetrically around a neck part 39, which has two wings 40, 41, and a central slit 42 for accommodating the end 17 of the compression spring 16. At the lower edge of the neck part 39, a paw 43 extends axially away from the head 36. At one end of the head 36, the head is provided with a wing 44, which protrudes sideways out of the front of the head, having an inner surface 45, which can provide a support against the adjacent outer surface 48 of the seal element. The wing 44 has a radially outer surface 46, which has the same radius of curvature as the outer sealing surface 38.

The inner surface 45 of the wing 44, is located against an adjacent seal element 13A, 15A, and can be displaced from a contracted position, as shown in FIG. 2, to an expanded position as shown in FIG. 3, forming a continuous overlap and seal.

Thus, in both the neutral or retracted condition shown in FIGS. 1 and 2 and in the activated condition shown in FIG. 3, there is overlap between the wing 44 of each head 36 and the portion 48 of an adjacent head 36, with a space present between the outer surfaces 38 of adjacent heads 36. In the operative or activated condition, the heads of the series of rings elements 13, 15 are forced radially outward and thereby produce an overall circumferential expansion of the ring to achieve a fluid seal against the well conduit. The fully circumferential fluid seal is formed by the series of spaced apart arcuate surfaces 38 that are bridged by the series of narrow arcuate surfaces 46, all of which have the same radius of curvature.

The front of head 36 of the seal element 13A, has a curved, downwards facing bevelled surface 47, which, in the operative position, forms a sealing support, and slides against the bevelled surface 28 of the pressure ring 24. In the operative position, there is also provided a radial force, which ensures that the outer sealing surface 38 of the seal element 13A, provides the necessary sealing against the wall of the well. Surface 47 of head 36 thus bears against surface 28 of pressure ring 24 to effectuate the ring expansion and create an inner fluid seal relative to the pull down mandrel 30. Mandrel 30 is separately sealed against the central mandrel element 32.

FIGS. 1 and 2 show the downhole plug, ready for insertion, or placing, in a well. Both series 13, 15, of seal elements 13A and 15A, lie symmetrically around the mid plane of the expansion sleeve 22. The seal function is activated by the pulling of the central mandrel 32, while holding the upper casing 12. The central mandrel 32 is connected to the lower casing 14, and thereby pushes the lower seal elements 15A up against the lower pressure ring 24, and the lower seal elements 13A up against the pressure ring 24, in such a way that they are pressed against the wall of the well, providing a seal against this wall. Thus, a sealing movement is achieved, which is symmetrical around the expansion sleeve or the "packer" 22, due to the upper seal elements 13A being held on the back or the upper casing 12.

When the expansion sleeve 22 is compressed between the annular series 13 and 15, there will be provided a force on the wings 44 of the seal elements 13A, 15A. This will result in the sealing of the slit between the inner surface 45 of the wing 44, and the curved axial front surface 48 of an adjacent seal element. The compressed expansion sleeve 22 also provides a fluid seal against the ring 24, at surface 27, and a fluid seal against the mandrel 30.

To remove the downhole plug, the upper casing 12 is pulled outwards, while the central mandrel 32, and the inner seal casing 14, is held back. During pulling, the elastic expansion sleeve 22 returns to its original diameter, and the compression springs 16 press the seal elements 13A, 15A, back into their initial position.

The task of the pull down mandrel 30 is to ensure that the pressure ring 24 is moved away from the seal elements in such a way that they may freely return to their initial position by means of the compression springs 16.

The invention can also be achieved with only one annular series of seal elements. Use of two series of seal elements 13A and 15A, will give the advantage or better intercepting compression forces from both sides during operation in the well.

The invention claimed is:

1. A downhole plug for closing an annular conduit of a well, having a ring element (13, 15), which is arranged on a cylindrical carrying element (32), between two mutually and axially movable pressure elements (12, 14), in such a way that the ring element is radially outwardly expandable downhole to a sealing position against the conduit while also sealed relative to the cylindrical carrying element (32), wherein the improvement comprises that the radially expandable ring element (13, 15) includes a closed series of overlapping individual elements (13A, 15A), which by the expanding movement are displaced mutually circumferentially into sealing engagement against each other to form a continuous circumferential outer sealing surface (38, 46) against the conduit, and which have a sealing surface (47) facing inward toward the carrying element (32);

the individual elements (13A, 15A), in the radially expandable ring element (13, 15), have a head (36), with an arcuate outer surface (38), which is arranged on a cylindrical surface, and a bevelled, inwards facing sealing surface (47), which is arranged on an annular surface, as the head (36) having a wing (44) that protrudes at one end, in the circumferential direction, to form a sealing support against the axial front surface (48) of an adjacent element; and a leaf shaped compression spring (16) is provided, which at one end is fixed to the adjacent cylindrical pressure element (12, 14), and which at the other end presses the single-element (13A, 15A) radially inwards for releasing from the cylindrical pipe wall by pulling.

2. Downhole plug according to claim 1, wherein the individual elements (13A, 15A) of the radially expandable ring element (13, 15) form a support by an inclined surface, having a bevelled edge (47), adjacent a pressure ring (24), with a bevelled support edge (28), and forming a support at one rear end against a cylindrical pressure element (12).

3. Downhole plug according to claim 2, wherein the compression spring (16) is arranged in an axial groove (21) in the cylindrical pressure element (12), as the free end (17) of the compression spring (16) is supported in an axial groove (42) in each individual element (13A, 15A) in the expandable ring element (13,15).

4. Downhole plug according to claim 2, wherein the expandable ring element (13, 15), having a pressure ring (24), is arranged axially and symmetrically on each side of an elastic sleeve (22).

5. Downhole plug according to claim 4, wherein the elastic sleeve (22) is a ring gasket, which under lateral compressive load, expands radially together with the adjacent expandable ring element (13, 15), exerting an axial force on this.

6. Downhole plug according to claim 2, wherein the individual elements are seal elements (13A, 15A), having a curved, annular segment-shaped head (36), with a bevelled front providing a sealing surface (47) against one bevelled surface (28) of the pressure ring (24), said sealing surface being operative in all radial positions of the sealing elements (13A, 15A), and the pressure ring (24) is sealed against the carrying cylinder (32).

7. Downhole plug according to claim 1, wherein the compression spring (16) is arranged in an axial groove (21) in the cylindrical pressure element (12), as the free end (17) of the compression spring (16) is supported in an axial groove (42) in each individual element (13A, 15A) in the expandable ring element (13, 15).

8. Downhole plug according to claim 7, wherein the expandable ring element (13, 15), having a pressure ring (24), is arranged axially and symmetrically on each side of an elastic sleeve (22).

9. Downhole plug according to claim 7, wherein the individual elements are seal elements (13A, 15A), having a curved, annular segment-shaped head (36), with a bevelled front providing a sealing surface (47) against one bevelled surface (28) of the pressure ring (24), said sealing surface being operative in all radial positions of the sealing elements (13A, 15A), and the pressure ring (24) is sealed against the carrying cylinder (32).

10. Downhole plug according to claim 1, wherein the expandable ring element (13, 15), having a pressure ring (24), is arranged axially and symmetrically on each side of an elastic sleeve (22).

11. Downhole plug according to claim 10, wherein the elastic sleeve (22) is a ring gasket, which under lateral compressive load, expands radially together with the adjacent expandable ring element (13, 15), exerting an axial force on this.

12. Downhole plug according to claim 11, wherein the pressure ring (24) is of a substantially conical cross section that converges radially against an end.

13. Downhole plug according to claim 10, wherein the individual elements are seal elements (13A, 15A), having a curved, annular segment-shaped head (36), with a bevelled front providing a sealing surface (47) against one bevelled surface (28) of the pressure ring (24), said sealing surface being operative in all radial positions of the sealing elements (13A, 15A), and the pressure ring (24) is sealed against the carrying cylinder (32).

14. Downhole plug according to claim 13, wherein the elastic sleeve (22) is a ring gasket, which under lateral compressive load, expands radially together with the adjacent expandable ring element (13, 15), exerting an axial force.

15. Downhole plug according to claim 1, wherein the pressure ring (24) is of a substantially conical cross section that converges radially against an end.

16. Downhole plug according to claim 1, wherein the individual elements are seal elements (13A, 15A), having a curved, annular segment-shaped head (36), with a bevelled front providing a sealing surface (47) against one bevelled surface (28) of the pressure ring (24), said sealing surface being operative in all radial positions of the sealing elements (13A, 15A), and the pressure ring (24) is sealed against the carrying cylinder (32).

17. Downhole plug according to claim 1, wherein fourteen seal elements (13A, 15A) are arranged in the expandable ring element (13, 15).

* * * * *